US005297992A

United States Patent [19]

Bailey et al.

[11] Patent Number: 5,297,992

[45] Date of Patent: Mar. 29, 1994

[54] METHOD AND APPARATUS FOR LIQUID SPILL CONTAINMENT

[75] Inventors: Douglas A. Bailey, Concord, Mass.; Peter M. Martino, Derry, N.H.; Barry R. Arsenault, Burlington, Mass.

[73] Assignee: Digital Equipment Corporation, Maynard, Mass.

[21] Appl. No.: 58,076

[22] Filed: May 4, 1993

[51] Int. Cl.[5] ..... F24F 7/10

[52] U.S. Cl. ..... 454/339; 52/302.3; 55/385.2; 454/187

[58] Field of Search ..... 52/303, 302, 507, 663, 52/97, 533; 55/385.2, 440; 210/163; 454/49, 66, 187, 289, 339, 228, 230, 233, 236

[56] References Cited

U.S. PATENT DOCUMENTS 1,150,746 8/1915 Darroch ..... 454/367

4,354,863 10/1982 Oleszak ..... 454/339 X 4,663,909 5/1987 Ogiho et al. ..... 454/185 X 5,180,331 1/1993 Daw et al. ..... 454/187

*Primary Examiner*—Harold Joyce

*Attorney, Agent, or Firm*—Richard J. Paciulan; Denis G. Maloney

[57] ABSTRACT

A liquid spill containment system inserted into an open airflow structure such that minimum interference with existing airflow occurs while simultaneously directing liquid spill particles into spill containers. A deflector is located below an upper partition portion of the open airflow structure. Spill containers are positioned below the deflector. The deflector and containers are located with respect to each other such that liquid particles coming through the open airflow structure are directed by the deflector into a container while, simultaneously, airflow entering the open air structure is exited unimpeded.

19 Claims, 10 Drawing Sheets

METHOD AND APPARATUS FOR LIQUID SPILL CONTAINMENT

FIELD OF THE INVENTION

This invention relates to the field of liquid spill containment, and, more particularly, liquid spill containment in structures through which air flows, such as those which may be employed in multi-level building construction such as semiconductor fabrication facilities.

BACKGROUND

Fluids when not properly contained can be destructive. Such destructiveness can be of immense scale or minute. For example, on the larger scale, rivers can flood, destroy property and injure people. Toxic liquid chemical spills can destroy items the spills come in contact with. On the smaller scale, fluids such as water, entering into electronic equipment such as radios, computer terminals can cause short circuiting of electrical wiring and even create electrical shock potential for users. On an intermediate scale, fluids and spills can affect building structures.

Modern semiconductor fabrication facilities utilize sophisticated technical manufacturing equipment, materials and chemicals such as acids and other fluids, and processing mechanisms such as pipes, feed systems and sinks, and are operated by personnel who work in various locations within the facilities. Many such facilities include multi-level building constructions with floors and ceilings separating upper and lower level vertically aligned rooms and work areas.

One critical aspect of a semiconductor fabrication facility is the necessity for a "clean room" environment, such that during manufacture the microscopic semiconductor "chips" do not become contaminated with foreign particles. Such clean rooms are designed such that circulated air flow is maintained uniform so that such particles are convected by air away from the chip products being manufactured. To accomplish such air flow, clean room floors are typically constructed with patterns of holes to allow air to flow from upper to lower levels in a constant "down flow" manner with a goal that the structures will avoid causing eddies, turbulence or other air flow interference.

Safety professionals in companies who have semiconductor fabrication facilities with such down flow configurations are concerned with safety matters regarding such open style floors and potential spills and leaks, particularly those involving toxic or corrosive chemicals typically used in the semiconductor fabrication process, which could penetrate the flooring used in such facilities. Injuries to personnel and damage to equipment can occur as a result of such leak or spill penetrations. For example, leaking sinks of acid could fall on expensive high voltage electrical equipment or come into physical contact with personnel who may be in the lower area. These spill problems can result in multi-million dollar costs to a semiconductor manufacturer if not effectively and efficiently addressed. Clean-up and replacement of damaged equipment can be costly. Product delays can result in lost profits. Injuries to personnel can be severe.

Therefore, a need exists for efficient cost effective spill containment while at the same time maintaining the uniform airflow needed in such facilities. Various prior approaches have been employed, all of which have disadvantages.

Several approaches involve merely instituting employee procedures. For example, all operations in an upper level are stopped while another worker is in the lower level (sub fab) area, or areas in the lower level below which chemical dispensing and possible spills may occur are chained off and contain "dangerous area" warning signs. If access to the "dangerous area" is required, hazardous work permits are issued and appropriate safety apparel, such as chemical resistant clothing, goggles, face shields, gloves, and the like would be worn when personnel access the area. While not causing an interruption in airflow, such procedures in addressing spill problems are inefficient, cumbersome and subject to human error.

Another approach is to install chemical resistant "umbrellas" on or over critical equipment in the lower level sub fab area and have personnel routinely wear appropriate safety apparel. "Spill pans" might also be located under equipment in the upper level. Such umbrellas and spill pans would typically need to be associated with each piece of equipment involved and would be costly additions to the equipment, particularly where chemical resistant materials are needed. Such umbrellas would not effectively protect personnel unless routinely carried by the workers in the lower level areas. In addition, such spill pans and umbrellas can adversely affect the uniform airflow.

Another technique involves installing a large container, or series of small containers packed close together, below the open flooring and spanning the entire room to capture any spills, or funnel spills into a adjacent receptacle(s) in the room below. However, again, such a large container or series of containers would interfere with the needed uniform airflow.

Another approach to spill containment is described in U.S. Pat. No. 5,180,331 titled "Subfloor Damper and Spill Container" issued to Daw et al where a spill container system is employed below open flooring. However, while the Daw approach captures spills and recognizes the need to maintain airflow, the Daw approach adds additional mechanical structural complexity to adjust for airflow interference created by its various embodiments. In addition, the size relationships of various elements used to practice the Daw invention do not optimize the amount of spill capture for a given pressure loss.

While the prior approaches may deal with solving spill containment, most do not address the need for simultaneous spill containment and airflow continuity. Where both are addressed (as in the Daw approach), complexities are added. What is needed is a simple, cost effective, easy to use and install, efficient approach for simultaneously addressing spill containment and uniform airflow. The invention as described herein provides such an approach.

SUMMARY OF THE INVENTION

A method and apparatus for liquid spill containment for structures, which include an upper partition through which air flows, is provided which not only contains spills but simultaneously allows airflow to pass through the spill containment apparatus with minimum interference. A deflector is located below the upper partition and positioned to direct simultaneously both airflow and liquid particles which passes into and through the upper partition. First and second spill containers are located below the deflector and each container has an upper extremity opening for capturing liquid directed thereinto from the deflector. The first container and second container each have side surfaces wherein one of the side surfaces of the first container is paired adjacent to one of the side surfaces of the second container such that the adjacent side surfaces channel exiting airflow while the upper extremity openings of the containers simultaneously capture and contain liquid entering the openings.

DETAILED DESCRIPTION

Figure 1:
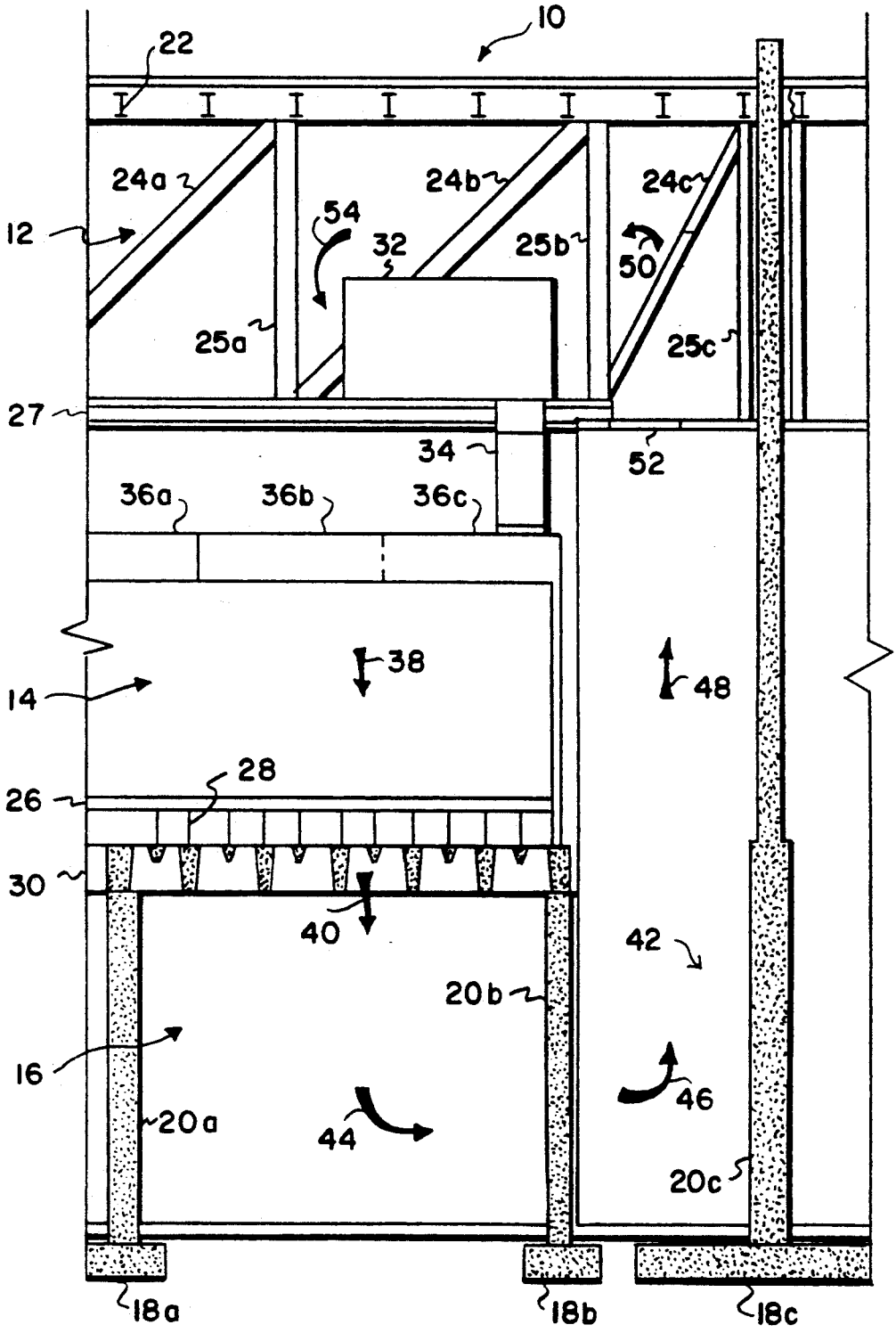
FIG. 1 shows a simplified elevational cross-sectional view of a portion of multi-level building structure of the type in which the invention may be employed.

FIG. 1 shows a simplified elevational cross-sectional view of a portion of multi-level building structure 10 with vertically aligned areas. The structure may have an upper-level air supply area 12, a mid-level "work in process" ("WIP") fabrication area 14, where the primary semiconductor chip fabrication takes place, and a lower-level "sub-Fab" area 16 which generally contains support equipment such as vacuum pumps, compressors, electrical supply units, and the like. The overall structure is supported by concrete foundation elements 18*a*, 18*b*, 18*c* and concrete columns 20*a*, 20*b*, 20*c*. Structural I-beams 22 are located throughout, and for clarity, are shown only above air supply area 12.

Air supply area 12 is shown supported by structural braces 24*a*, 24*b*, 24*c*, columns 25*a*, 25*b*, 25*c* and has a floor 27.

WIP area 14 may contain similar braces and columns but these are typically hidden in or behind walls and are not shown here for clarity. Lower partition 30, one form of which is generally known as a "waffle-floor assembly", supports a series of posts 28, which in turn support upper partition 26. Upper partition 26 is typically a raised floor made up of individual floor sections which when placed side by side constitute the overall upper partition. The lower partition, posts and upper partition are more fully described hereinafter as used in conjunction with the preferred embodiment of the invention.

To maintain a uniform airflow circulation through the WIP area an airflow system is utilized. A typical airflow system comprises an air mover 32, which is part of an overall facility heating/air conditioning/ventilation system, and is situated in air supply area 12. Air mover 32 generally comprises a fan and other elements ( not shown ) for prefiltering, heating, cooling and the like. Duct 34 receives air from air mover 32. The air passes through filters 36*a*, 36*b*, 36*c* situated in the ceiling area of WIP area 14. The air in WIP area 14 flows as indicated by air direction arrow 38. Upper partition 26 and lower partition 30 are constructed with holes to allow air floor through upper partition 26 and lower partition 30. The details of the hole structure will be shown hereinafter. Air flows through the upper partition and lower partition as indicated by airflow direction arrow 40 and into the sub-Fab area 16 where return air duct 42 permits the airflow to change direction as indicated in airflow direction arrows 44, 46, 48. The air passes through grate 52 and air to air mover 32 as indicated by airflow direction arrows 50, 54 to close the airflow circulation loop.

Figure 2:
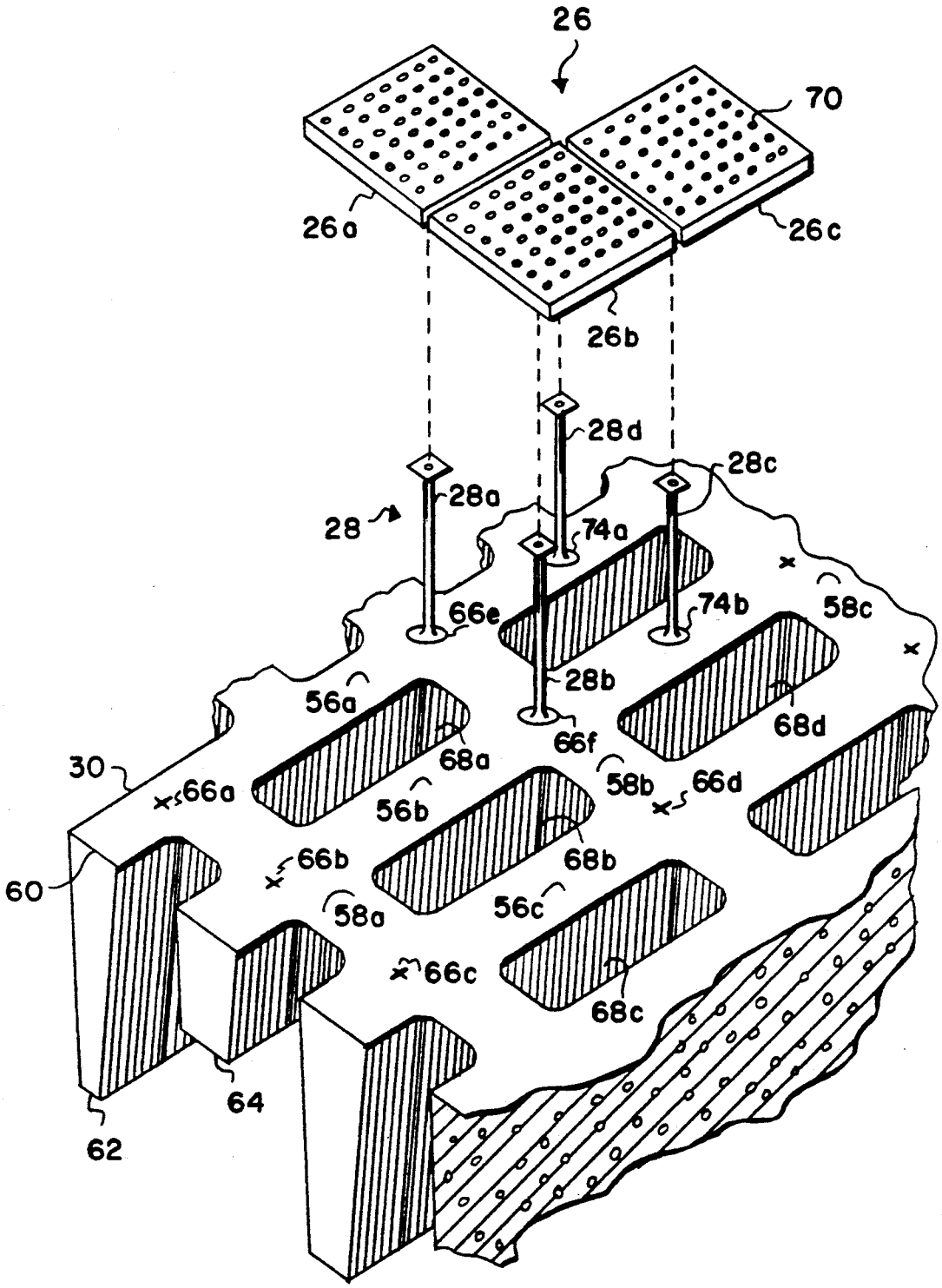
FIG. 2 shows the detail of an exploded perspective view of a portion of a typical open airflow floor assembly of the type with which the invention may be employed.

FIG. 2 shows the detail of an exploded perspective view of a portion of a typical open airflow floor assembly with which the invention may be used.

One typical lower partition 30 is known as a "waffle-floor assembly" and is typically steel reinforced concrete having first axis webs 56*a*, 56*b*, 56*c* . . . 56*n* spanning the length of a WIP area and second axis bracing webs 58*a*, 58*b*, 58*c* . . . 58*n* spanning the width of a WIP area. Lower partition 30 is supported by structural columns not shown. Each of the webs are typically 12" wide along flat top surface 60. First web 56*a* has a taper to a depth of typically 4' to end 62. Adjacent web 56*b* has a taper to a depth of typically 2' to end 64. The balance of webs 56*n* alternate in similar fashion through the WIP area. Web intersections have centers 66*a*, 66*b*, 66*c*, 66*d*, . . . 66*n*. The lower partition is typically precast such that elliptical holes 68*a*, 68*b*, 68*c*, 68*d* . . . 68*n* are formed. These holes permit air-flow to pass through the lower partition as described above.

Upper partition 26 is comprised of individual upper partition sections 26*a*, 26*b*, 26*c* . . . 26*n* and span the length and width of the WIP area. Each individual upper partition section may be a grating made of aluminum. A multiplicity of holes 70, random or in patterns, span the upper partition section surface and pass through its depth. The holes 70 thereby permit airflow to pass through the upper partition as described above.

The upper partition 26 is supported above lower partition 30 by posts 28. Each upper partition section, for example, section 26*b*, is typically supported by posts 28*a*, 28*b*, 28*c*, 28*d*. A typical post is shown in more detail hereinafter. Each of the group of four posts per upper partition section are situated on the lower partition such that one pair posts are located at a web intersection points, e.g., 66*e*, 66*f*, and the other pair of posts are located half way along first axis webs 56*a* and 56*b* at points 74*a* and 74*b*. This pattern of posts supporting upper partition sections spans the length and width of the WIP area, each upper partition sections typically having posts located at web intersections and at halfway points along the webs.

Figure 3:
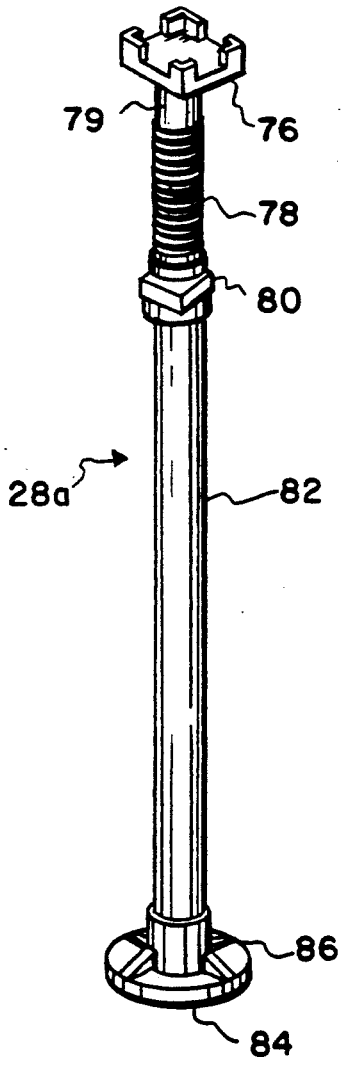
FIG. 3 shows one type of post which supports upper partitioning as used in the open airflow floor assembly as shown in FIG. 2.

FIG. 3 shows a typical post 28a. The post contains pad 76 for supporting and locating a corner of an upper partition section. A threaded portion 78 is located on an inner shaft 79 and permits the extension and contraction of the length of the post. Locking nut 80 secures the length adjustment of the threaded area. Outer shaft 82 connects to base 84. Base 84 contains gusset ribs 86 for structural reinforcement. Such posts are typically made of aluminum.

The above described lower partition, posts and upper partition reflect one type of flooring construction which permits airflow. Variations thereto can be made by those skilled in the building construction and flooring art, including, but not limited to: waffle-floor assemblies having varying web dimensions, hole sizes and material composition; the posts having varying pad styles, length adjustments and base designs; and upper partition sections having varying hole shapes, patterns, and structure.

Figure 4:
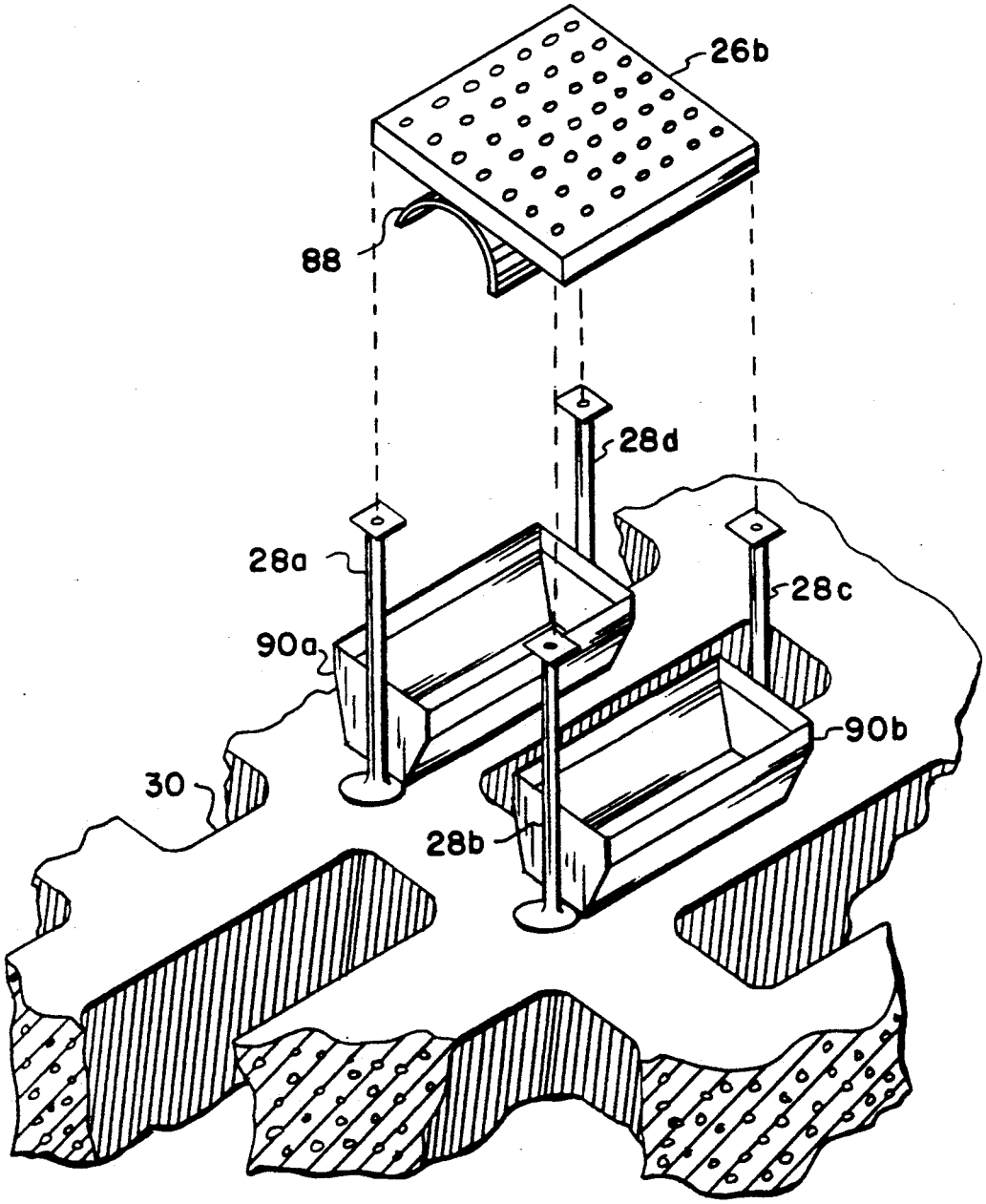
FIG. 4 is an exploded perspective view of portion of an open airflow flooring assembly in which a preferred embodiment of the invention is shown.

FIG. 4 shows the preferred embodiment of the invention where a deflector 88 may be fastened to the lower side of typical upper partition section 26b and first and second containers 90a, 90b respectively, are located on the top surface of lower partition 30 and between a typical grouping of four posts 28a, 28b, 28c, 28d which support upper partition section 26b. The details of the deflector attachment and container location with respect to the posts and the deflector are hereinafter described in more detail.

Figure 5:
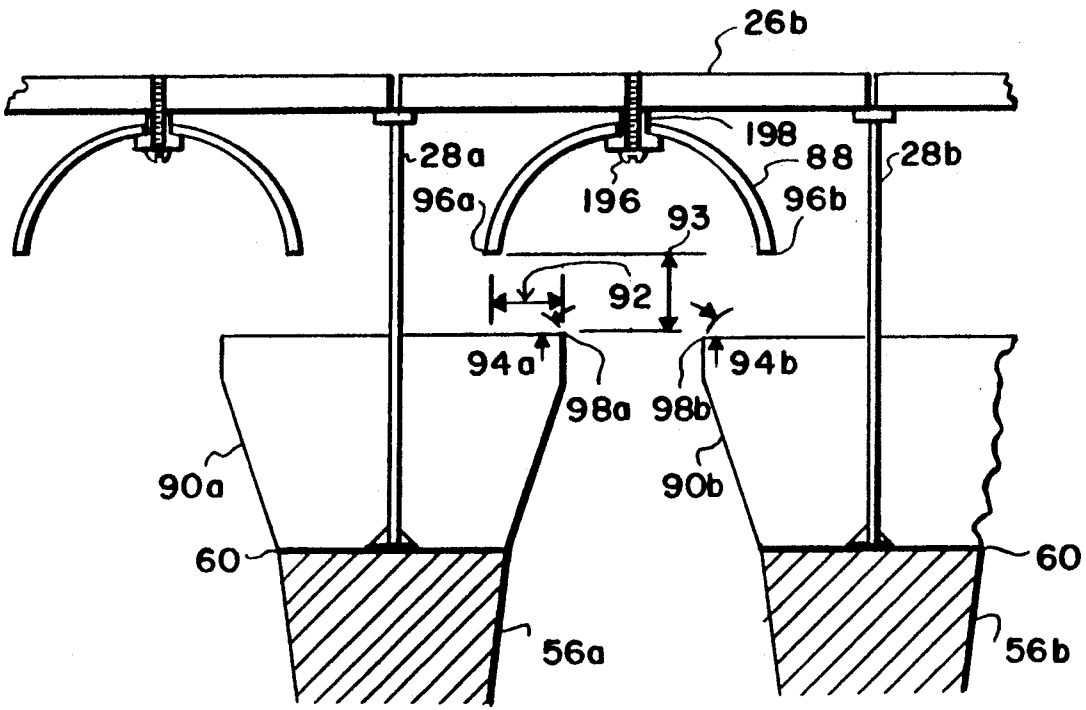
FIG. 5 shows a simplified plan view of the interrelationship of the preferred embodiment of the invention elements shown in FIG. 4.

FIG. 5 depicts a simplified plan view of the interrelationship of deflector 88, containers 90a and 90b, posts 28a and 28b, upper partition section 26b and lower partition webs 56a and 56b, each web having a top surface 60 with containers 90a, 90b resting thereon. Deflector 88 may be fastened to upper partition section 26b via screw 196 and bushing 198, the details of which are hereinafter set forth. In a preferred embodiment, deflector extremities 96a, 96b overlap container extremities 98a and 98b respectively such that typical overlap dimension 92 is greater than zero and approximately the same as dimension 93 between the deflector lower extremity and the container upper extremity, such that angles 94a, 94b are respectively each approximately 45 degrees.

Figure 6:
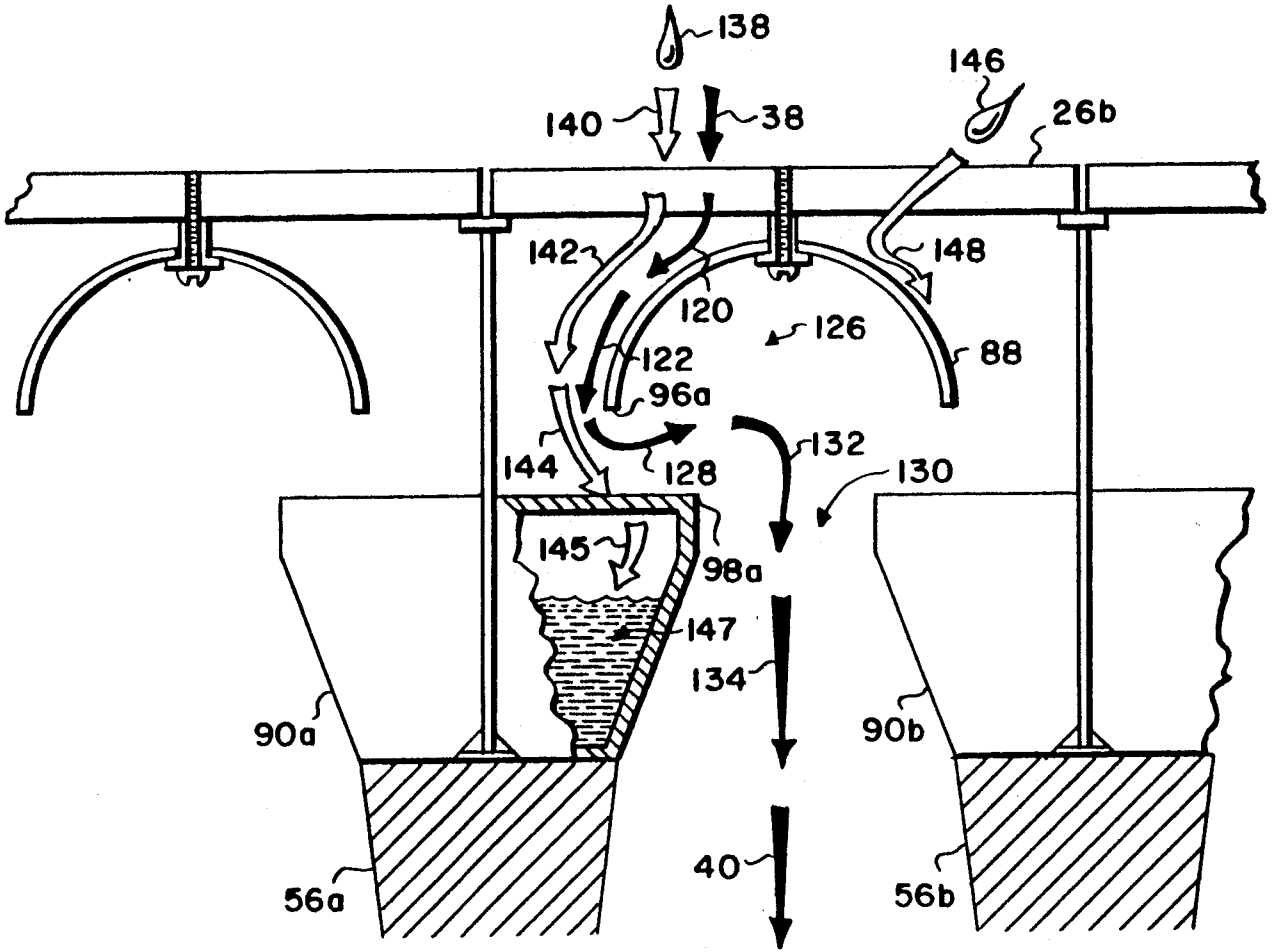
FIG. 6 depicts airflow and liquid flow in a preferred embodiment of the invention.
Figure 7:
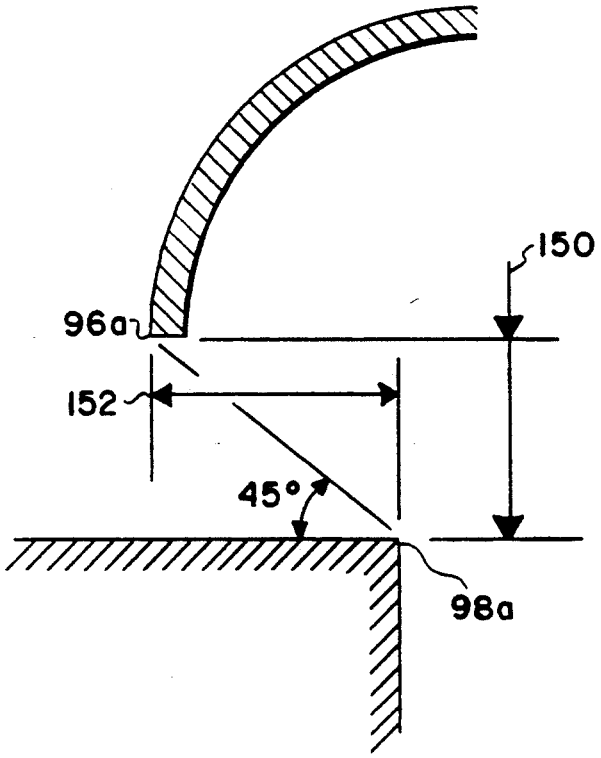
FIG. 7 shows a more detailed view of the relationships of an extremity of a deflector and an extremity of a container.

Referring now to FIG. 6, the functioning of the preferred embodiment of the invention is depicted. Airflow as indicated by airflow direction arrow 38 (also as shown in FIG. 1) would enter the upper partition section 26b and as it contacts deflector 88 would be redirected along deflector 88 as indicated by airflow direction arrow 120. As the air continues along the deflector as indicated by airflow direction arrow 122, the air accelerates as it passes the lower and width-wide extremity 96a of deflector 88. With a pressure gradient in the area of width-wide extremity 96a as a result of the air acceleration at this point and the pressure in area 126 under deflector 88, the airflow changes direction as indicated by airflow direction arrow 128 and passes above and by upper and width-wide extremity 98a of container 90a. Similarly, as the airflow reaches the area 130 between the surfaces of adjacent containers 90a, 90b the pressure gradient in this location causes the airflow to again change direction as indicated by airflow direction arrow 132. As the airflow passes between the adjacent containers as indicated by airflow direction arrow 134, the angling of the container walls acts both as a channel for exiting airflow and as a diffuser whereby dynamic head is converted to a rise in static pressure and the airflow exits between the typical lower partition ribs 56a, 56b as indicated by airflow direction arrow 40 (also as shown in FIG. 1). In the preferred embodiment, the upper and width-wide extremity 98a is at a 45 degree angle with respect to lower and width extremity 96a of deflector 88 such that dimension 150 is approximately the same as dimension 152 as is shown in more detail in FIG. 7. This "serpentine" airflow path has low pressure loss and as a result there is little impediment in the overall airflow as the air passes through the upper portion partition and the lower portion lower partition.

Still referring to FIG. 6, while the airflow is not being impeded, simultaneously, a liquid passing into the upper partition section 26b, as depicted by liquid particle 138 and it's initial liquid flow direction arrow 140, contacts deflector 88 and flows along the deflector as indicated by liquid flow direction arrow 142. (For clarity the liquid flow is depicted by an arrow shown above the airflow direction arrows, but in actuality the liquid would physically contact the deflector.) As the liquid particle also accelerates at lower and width-wide extremity 96a of deflector 88, its mass and momentum does not allow it to follow the path of the airflow as indicated by airflow direction arrow 128, but instead is directed into the container 90a as indicated by liquid direction arrows 144, 145. The difference in density between air and liquid and the resulting pressure gradients of the configuration helps separate the liquid and air. The spill represented by particle 138 is thereby captured and settles in fluid collection 147 within container 90a. The spill is thereby contained from passing into the area of the lower partition and below. In the configuration of the preferred embodiment liquid particles down to sizes of 0.001-inch diameter can be captured. Should a spill occur as a result of a dropped container creating liquid particles having high lateral velocities as depicted by liquid particle 146, such particles would similarly be contained as depicted by liquid flow direction arrow 148 showing the particle contacting deflector 88 and following a downward path similar to that taken by liquid particle 138. This occurs as a result of the preferred embodiment of deflector 88 as having a cylindrical surface.

Figures 8, 9:
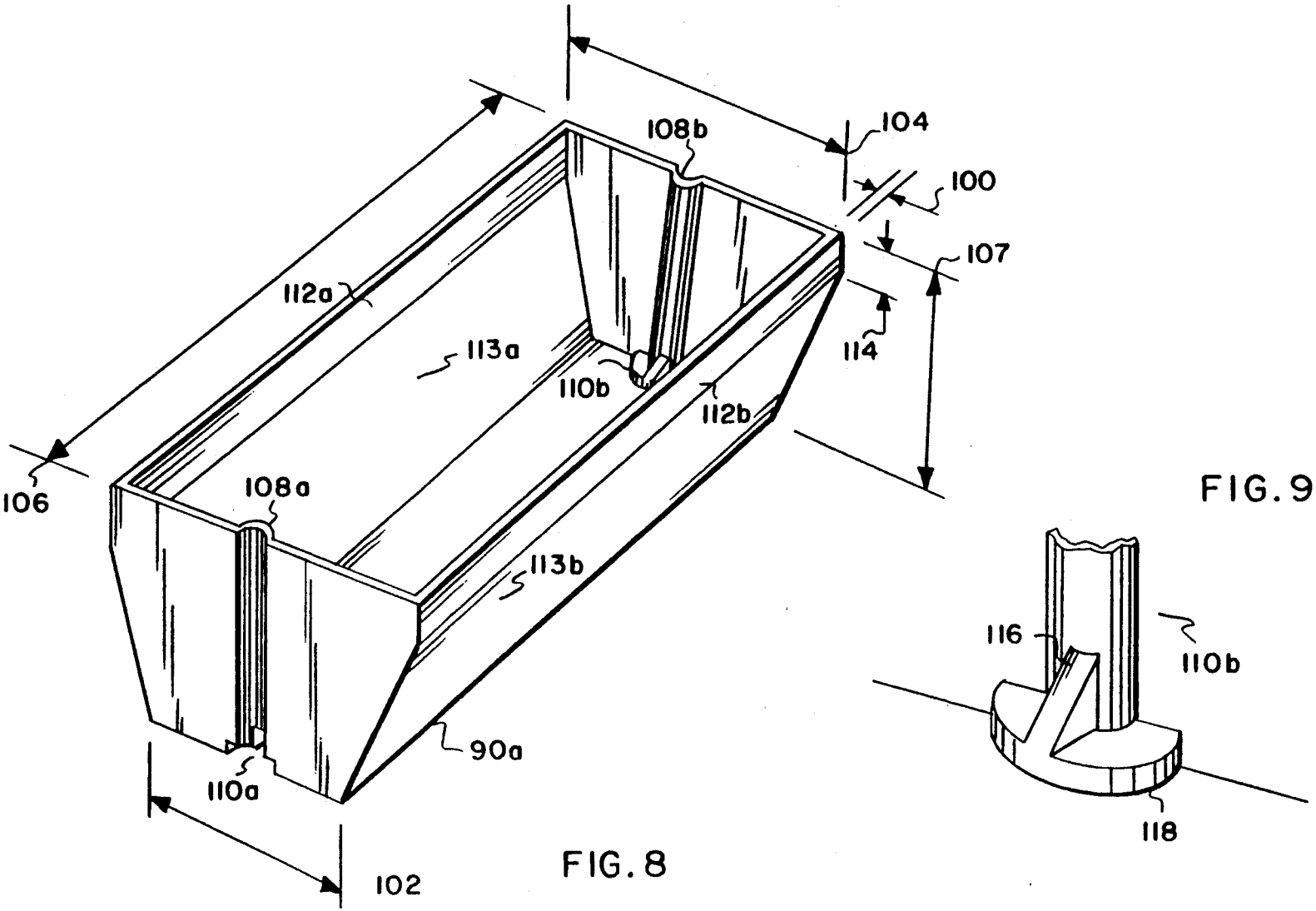
FIG. 8 shows a typical container used in the preferred embodiment of the invention.
FIG. 9 shows a more detailed view of a portion of a typical container shown in FIG. 8.

FIG. 8 shows a container 90a in more detail. It is typically manufactured as a preformed molded unit made of chemical resistant material such as polyethylene. The container 90a used in conjunction with lower partition dimensions as described above would have a uniform thickness dimension 100, a lower end width-wide extremity dimension 102, an upper end width-wide extremity dimension 104, an overall length dimension 106 and a height dimension 107. Width-wide extremity dimension 102 would approximate lower partition web 56 width dimension. Length dimension 106 would approximate the locations 66e and 74a of typical post pairings as shown in FIG. 2. To allow the container to effectively sit between the typical post pairings, preformed half-cylindrical shafts 108a, 108b and preformed post base and gusset rib notches 110a and 110b are located at each end of the container 90a. Top side surfaces 112a, 112b of each side of container 90a would encompass a planar surface having dimension 114, thereby allowing the container to gradually taper top to bottom from the 104 width dimension to the 102 width dimension via surface planar surfaces 113a, 113b.

FIG. 9 shows a more detailed view of notch 110b as looked at from the inside of container 90a. The notch 110b would have a recess 116 to accept typical post gusset rib 86 and recess 118 to accept typical post base 84 as shown in FIG. 3. Needless to say, as different shapes of posts and their bases are used, corresponding preformed shafts/notches to accept such shapes would be alternative recesses of the preformed container 90*a*.

Referring now back to FIGS. 3 and 4, container 90*a* as shown in FIG. 4 would be located on lower partition 30 by first disassembling post 28*a*. Inner shaft 79 is removed from outer shaft 82 by loosening locking nut 80 and unthreading inner shaft 79 from outer shaft 82. This would be done for corresponding posts 28*a* and 28*d*. Container 90*a* would be then seated on lower partition 30 such that post outer shaft 82, gusset rib 86 and base 84 seat into container half-cylinder 108*a* and notch 110*a*. Inner shaft 79 would then be replaced by retreading inner shaft 79 back into outer shaft 82 and tightening locking nut 80 after adjusting the post to whatever proper height is desired. A similar disassembly-assembly sequence would take place for seating adjacent container 90*b* between posts 28*b* and 28*c*.

Figure 10:
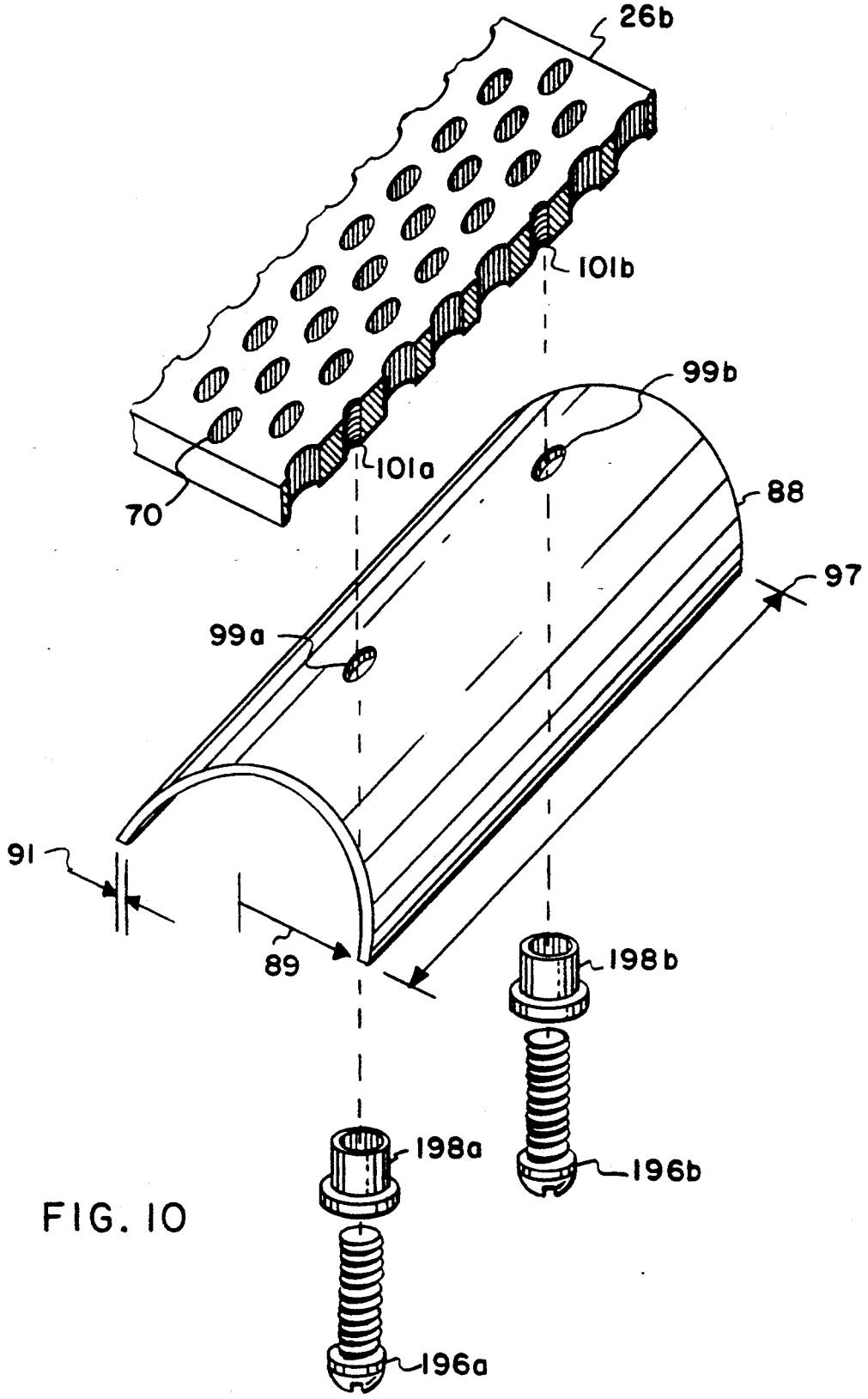
FIG. 10 is an exploded view showing the attachment of a deflector to an upper partition.

FIG. 10 shows an exploded perspective view of the attachment of deflector 88 to upper partition section 26*b*. Deflector 88 is typically manufactured as a preformed molded unit made of chemically resistant material such as polyethylene. Deflector 88 would have a length dimension 97 corresponding to container length dimension 106. Deflector 88, in the preferred embodiment would be a half-cylinder of thickness 91 and an inner radius 89. Two thru-holes 99*a*, 99*b* would be located in the top of deflector 88. The spacing between the thru-holes would be dictated by the location of the centerlines of tapped holes 101*a*, 101*b*. The tapped holes in upper partition section 26*b* would be centrally located and positioned to avoid contacting any of the holes 70 and allowing proper thread wall thickness. To fasten deflector 88 to upper partition section 26*b*, bushings 198*a*, 198*b* would be inserted through thru-holes 99*a* and 99*b* and screws 196*a*, 196*b* inserted through the bushings 198*a*, 198*b*. Screws 196*a*, 196*b* would engage threaded holes 101*a*, 101*b* and be tightened accordingly to secure the deflector to its corresponding upper partition section. This assembly sequence would occur for each upper partition section.

Figure 11:
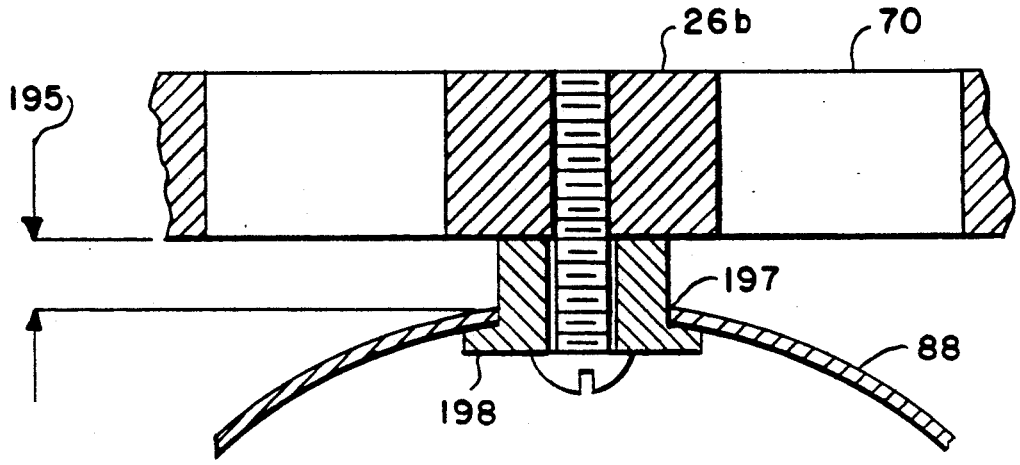
FIG. 11 shows a more detailed sectioned view of a deflector attached to an upper partition as shown in FIG. 10.

FIG. 11 shows a more detailed sectioned view of deflector 88 attached to upper partition section 26*b*. Bushing 198*a* is sized such that gap dimension 195 allows clearance between the bottom of upper partition section 26*b* with its holes 70 and the top most portion of the outer surface 197 of deflector 88. This gap allows a smooth airflow transition from the holes to the deflector.

The embodiment of the invention described above lends itself to easy cleaning of the spills captured in the spill containers. The upper partition section with the deflector attached is lifted off its support posts exposing the containers below. The liquid in the containers can then be pumped out. Since the deflector and containers are not physically interconnected, such makes the liquid removal straight forward.

While a preferred embodiment has been described herein, variations will become apparent to those skilled in the art without departing from the principles and spirit of the invention, the scope of which is defined in the appended claims.

For example, rather than having a half-cylindrically shaped deflector, the deflector could be triangular, much like a house roof top. Rather than being attached to the upper partition section, the deflector could be hung from the top of the support posts. Similarly, rather than resting on the top surface of the waffle-floor assembly, the spill containers could be hung from the top of the support posts.

In addition, while the spill containment method and apparatus has been described in a preferred embodiment for use in a building structure, other embodiments of the invention have utility in other structures, such as in equipment enclosures for electronic, mechanical, optical, and the other devices, each of which may have a uniform airflow circulating through a chassis housing parts for which protection from spills would be needed.

For example, referring back to FIG. 6, the functioning of an embodiment of the invention can also apply whereby the structure, rather than a building structure, is a computer terminal enclosure housing therein electronic modules. Airflow as indicated by airflow direction arrow 38 could enter the top of the computer terminal housing where airflow is being moved throughout the housing via a fan or blower within the housing. In FIG. 6 airflow enters the upper partition section 26*b*, and exits between lower partition ribs 56*a*, 56*b*. The upper partition could be a platform inserted within the housing and having appropriate openings to allow air to flow and cool electronic modules located below. A similar deflector and tray relationship would be established and situated with respect to the platform. Spills entering the top of the housing, for example, when coffee is spilled above a computer terminal located on a desktop and fluid enters openings typically on the top of the terminal housing, can be contained and prevented from entering the area below the platform such that the spill does not contact and damage delicate electronic modules located within the housing. As provided by the invention, airflow needed to keep the computer terminal cooled would note be interfered with. Deflector 88 and trays 90*a*, 90*b* can be miniaturized and function as has been hereinabove described with respect to airflow and liquid flow. Similarly, other embodiments for mechanical and other equipment contained in other enclosures can be implemented by those skilled in the art and fall within the scope and spirit of the invention.

What is claimed is:

1. A liquid spill containment apparatus for use in structures which include an upper orificial partition through which air flows, comprising:

a) a deflector located below said upper partition, said deflector positioned to direct simultaneously both airflow and liquid particles which pass into and through the upper partition, and b) a first container and a second container, each container located below the deflector and having an upper extremity opening for capturing liquid directed thereinto from said deflector, said first container and said second container each having side surfaces wherein one of said side surfaces of said first container being paired adjacent to one of said side surfaces of said second container such that said adjacent side surfaces channel exiting airflow while said upper extremity openings of said containers simultaneously capture and contain liquid entering said openings.

2. A liquid spill containment apparatus as in claim 1, wherein a) said deflector has width-wide extremities and a lower extremity, and b) each of said openings have width-wide opening extremities, each of said openings located such that one of the first container's width-wide opening extremities is below the deflector lower extremity and outside one of said deflector width-wide extremities, and one of the second container's width-wide opening extremities is below said deflector lower extremity and outside said other deflector width-wide extremity.

3. A liquid spill containment apparatus as in claim 2 wherein an overlap distance between a deflector width-wide extremity and an opening width-wide extremity is approximately the same distance as the distance between said deflector lower extremity and said opening.

4. A liquid spill containment apparatus as in claim 1 wherein said containers have an upper extremity width which is larger than its own lower extremity width such that the two adjacent side surfaces of said first container and said second container form an airflow diffuser.

5. A liquid spill containment apparatus as in claim 1, wherein said deflector is attached to said upper partition.

6. A liquid spill containment apparatus as in claim 5, wherein said containers are supported by a lower orificial partition through which air flows.

7. A liquid spill containment apparatus as in claim 6, wherein the deflector has a half-cylindrical outer surface.

8. A liquid spill containment apparatus as in claim 7, wherein the deflector has a half-cylindrical inner surface.

9. A liquid spill containment apparatus as in claim 1, wherein said upper partition forms part of a flooring system in a building structure.

10. A liquid spill containment apparatus as in claim 1, wherein said upper partition forms part of an equipment enclosure.

11. A liquid spill containment apparatus as in claim 10, wherein said equipment enclosure is a housing for electronic modules.

12. A method of liquid spill containment for use in structures which include an upper partition through which air flows, comprising the steps of:

a) locating a deflector below said upper partition and positioning said deflector to direct simultaneously both airflow and liquid particles which pass into and through the upper partition, and b) locating below the deflector a first container and a second container, each having an upper extremity opening for capturing liquid directed thereinto from said deflector, and said first container and said second container each having side surfaces, and pairing one of said side surfaces of said first container adjacent to one of said side surfaces of said second container such that said adjacent side surfaces channel exiting airflow while said upper extremity openings of said containers simultaneously capture and contain liquid entering said openings.

13. A method of liquid spill containment as in claim 12, further comprising the steps of:

a) forming said deflector such that it has width-wide extremities and a lower extremity, b) forming each of said openings such that they have width-wide opening extremities, c) locating each of said openings such that one of the first container's width-wide opening extremities is below the deflector lower extremity and outside one of said deflector width-wide extremities, and one of the second container's width-wide opening extremities is below said deflector lower extremity and outside said other deflector width-wide extremity.

14. A method of liquid spill containment as in claim 13 further comprising the step of creating an overlap distance between a deflector width-wide extremity and an opening width-wide extremity which is approximately the same distance as the distance between said deflector lower extremity and said opening.

15. A method of liquid spill containment as in claim 12 further comprising the step of using containers which have an upper extremity width which is larger than its own lower extremity width such that when the two side surfaces of said first container and said second container are adjacent to each other an airflow diffuser is formed.

16. A method of liquid spill containment as in claim 12, further comprising the step of attaching said deflector to said upper partition.

17. A method of liquid spill containment apparatus as in claim 16, further comprising the step of supporting said containers by a lower partition through which air flows.

18. A method of liquid spill containment as in claim 17, further comprising the step of forming the deflector outer surface as a half-cylinder.

19. A method of liquid spill containment as in claim 18, further comprising the step of forming the deflector inner surface as a half-cylinder.

* * * * *